US009087474B2

(12) United States Patent
Seong et al.

(10) Patent No.: US 9,087,474 B2
(45) Date of Patent: Jul. 21, 2015

(54) LIQUID CRYSTAL DISPLAY DEVICE AND DRIVING METHOD THEREOF

(71) Applicant: LG Display Co., Ltd., Seoul (KR)

(72) Inventors: NakJin Seong, Jung-Ri (KR); SangSoo Han, Namyul-ri (KR)

(73) Assignee: LG Display Co., Ltd., Seoul (KR)

( * ) Notice: Subject to any disclaimer, the term of this patent is extended or adjusted under 35 U.S.C. 154(b) by 216 days.

(21) Appl. No.: 13/649,223

(22) Filed: Oct. 11, 2012

(65) Prior Publication Data

US 2013/0088477 A1 Apr. 11, 2013

(30) Foreign Application Priority Data

Oct. 11, 2011 (KR) ..... 10-2011-0103767
Sep. 14, 2012 (KR) ..... 10-2012-0101916

(51) Int. Cl.
*G09G 3/36* (2006.01)
*G09G 1/00* (2006.01)

(52) U.S. Cl.
CPC ..... *G09G 1/005* (2013.01); *G09G 3/3688* (2013.01); *G09G 3/3696* (2013.01); *G09G 2300/0426* (2013.01); *G09G 2320/0276* (2013.01)

(58) Field of Classification Search
CPC ..... G09G 3/3688; G09G 2300/0426; G09G 2320/0276; G09G 1/005; G09G 2330/021; G09G 3/3696; G09G 3/3233; G09G 2330/02; G09G 2300/0842; G09G 2360/16; G09G 2320/0626; G09G 3/3648; G09G 3/3611
USPC ..... 345/87–104, 204–214, 690–699
See application file for complete search history.

(56) References Cited

U.S. PATENT DOCUMENTS

| | | | | |
|---|---|---|---|---|
| 8,519,926 | B2 * | 8/2013 | Lim | 345/87 |
| 8,638,359 | B2 * | 1/2014 | Kim et al. | 348/51 |
| 8,665,606 | B2 * | 3/2014 | Feng et al. | 361/784 |
| 2004/0113923 | A1 | 6/2004 | Ha et al. | |
| 2006/0202929 | A1 * | 9/2006 | Baum et al. | 345/89 |

(Continued)

FOREIGN PATENT DOCUMENTS

| | | |
|---|---|---|
| CN | 1506932 A | 6/2004 |
| CN | 1901021 A | 1/2007 |

(Continued)

OTHER PUBLICATIONS

Office Action issued in corresponding United Kingdom Patent Application No. GB1217784.6, mailed Jan. 25, 2013.

(Continued)

*Primary Examiner* — Dmitriy Bolotin
(74) *Attorney, Agent, or Firm* — Brinks Gilson & Lione

(57) ABSTRACT

An LCD device and a driving method thereof are provided. The LCD device includes a plurality of data driver ICs, a timing controller, a reference voltage generator, and a PCB. The data driver ICs include a gamma voltage generator which generates a gamma voltage. The timing controller generates an EPI packet for controlling the data driver ICs. The reference voltage generator reduces the driving voltage, and supplies the reduced driving voltage to the data driver IC. The reference voltage generator, the data driver ICs, and the timing controller are mounted on the PCB. A first transmission line which connects the reference voltage generator and the data driver ICs, and a second transmission line which connects the timing controller and the data driver ICs are formed on the PCB.

16 Claims, 13 Drawing Sheets

(56) References Cited

U.S. PATENT DOCUMENTS

| | | | | |
|---|---|---|---|---|
| 2006/0202935 | A1* | 9/2006 | Yi | 345/98 |
| 2007/0018922 | A1 | 1/2007 | Lee et al. | |
| 2007/0040773 | A1 | 2/2007 | Lee et al. | |
| 2007/0120805 | A1* | 5/2007 | Yi | 345/100 |
| 2008/0001894 | A1* | 1/2008 | Oh et al. | 345/98 |
| 2008/0001897 | A1* | 1/2008 | Lim | 345/98 |
| 2008/0150930 | A1* | 6/2008 | Nam et al. | 345/212 |
| 2009/0040167 | A1* | 2/2009 | Sun | 345/99 |
| 2009/0237386 | A1* | 9/2009 | Wu et al. | 345/211 |
| 2010/0045587 | A1* | 2/2010 | Tu et al. | 345/99 |
| 2010/0097361 | A1* | 4/2010 | Oku | 345/209 |
| 2010/0127960 | A1* | 5/2010 | Jung et al. | 345/89 |
| 2010/0148829 | A1* | 6/2010 | Hong et al. | 327/108 |
| 2011/0032279 | A1* | 2/2011 | Kim et al. | 345/690 |
| 2011/0090319 | A1* | 4/2011 | Kim et al. | 348/51 |
| 2011/0157142 | A1* | 6/2011 | Chung | 345/212 |
| 2011/0193844 | A1* | 8/2011 | Lee et al. | 345/211 |
| 2012/0014080 | A1* | 1/2012 | Feng et al. | 361/784 |
| 2012/0162178 | A1* | 6/2012 | Oh | 345/211 |
| 2013/0050298 | A1* | 2/2013 | Su et al. | 345/691 |

FOREIGN PATENT DOCUMENTS

| | | | |
|---|---|---|---|
| CN | 1917018 | A | 2/2007 |
| CN | 101097317 | A | 1/2008 |
| KR | 20050015303 | A | 2/2005 |
| KR | 20110076015 | A | 7/2011 |

OTHER PUBLICATIONS

Office Action issued in Chinese Patent Application No. 201210384132.X, mailed Jul. 2, 2014, 17 pages.

* cited by examiner

FIG. 5

| | Control data | name | bit | description |
|---|---|---|---|---|
| | CTR_start | indicator | C[5:0] | Control packet start indicator(LSB→MSB) |
| | | dummy | C[17:6] | |
| Packet data | CTR0 | GMA1 | G1[3:0] | **Gamma #1 Voltage control** |
| | | GMA2 | G2[3:0] | **Gamma #2 Voltage control** |
| | | GMA3 | G3[3:0] | **Gamma #3 Voltage control** |
| | | GMA4 | G4[3:0] | **Gamma #4 Voltage control** |
| | | GMA5 | G5[3:0] | **Gamma #5 Voltage control** |
| | | GMA6 | G6[3:0] | **Gamma #6 Voltage control** |
| | | GMA7 | G7[3:0] | **Gamma #7 Voltage control** |
| | | GMA8 | G8[3:0] | **Gamma #8 Voltage control** |
| | | GMA9 | G9[3:0] | **Gamma #9 Voltage control** |
| | | GMA10 | G10[3:0] | **Gamma #10 Voltage control** |
| | CTR1 | SOE start | C[7:0] | |
| | | SOE width | C[17:8] | |
| | CTR2 | POL | C0 | Polarity inversion |
| | | MODE | C1 | Fixed to Low |
| | | H2DOT | C2 | Horizontal 2 Dot inversion |
| | | LTD1 | C3 | Low temperature drive model selection |
| | | LTD2 | C4 | |
| | | PWRC1 | C5 | Output buffer power control |
| | | PWRC2 | C6 | |
| | | PWRC3 | C7 | |
| | | dummy | C8 | |
| | | GSP | C9 | Gate start pulse to indicate frame start time |
| | | CSC | C10 | Change share mode control |
| | | GMAENB1 | C11 | Gamma buffer enable |
| | | GMAENB2 | C12 | |
| | | POLC | C13 | Polarity control |
| | | Reserved | C14 | |
| | | Reserved | C15 | |
| | | Reserved | C16 | |
| | | Reserved | C17 | |
| | Data_start | indicator | C[5:0] | Data packet start indicator(LSB→MSB) |
| | | dummy | C[17:6] | |

FIG. 6
< EPI packet sequence >
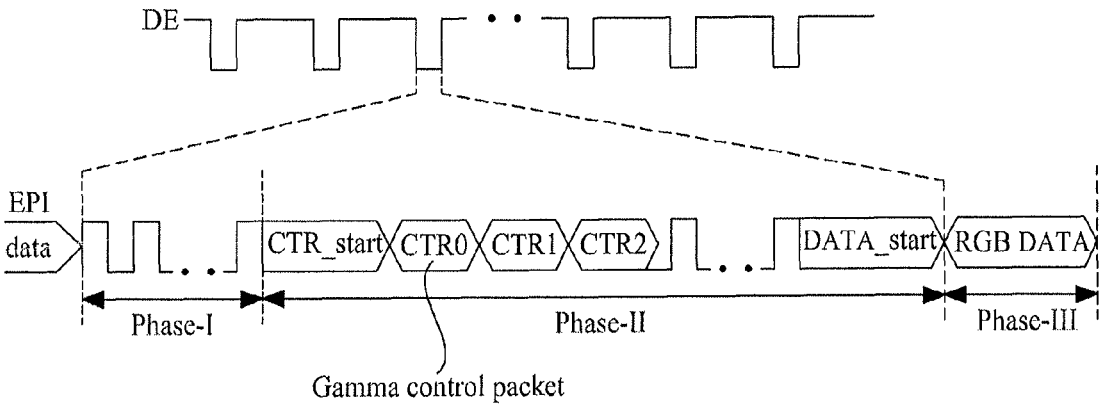
< EPI packet description >
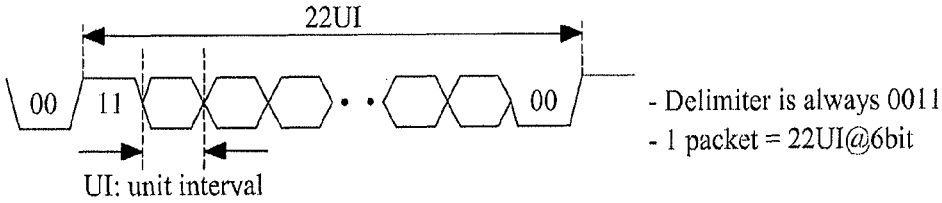
< EPI DATA packet >
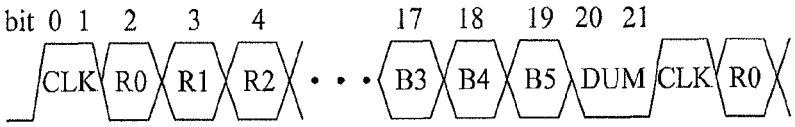
FIG. 7
< EPI packet >
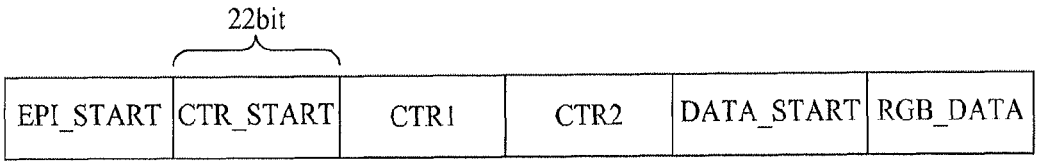

FIG. 8

<CTR_START>

| Bit # | Name | Default | Function |
|---|---|---|---|
| 0, 1 | CK | HH | Higher 2bits of the embedded clock |
| 2 ~ 7 | CTR_START | HL HL HL | Indicates the next packet is the control packet |
| 8 ~ 10 | GMA_DEC | - | **G[0:2] : Gamma Decoder for GMA1** |
| 11 ~ 13 | GMA_DEC | - | **G[3:5] : Gamma Decoder for GMA2** |
| 14 ~ 16 | GMA_DEC | - | **G[6:8] : Gamma Decoder for GMA3** |
| 17 ~ 19 | GMA_DEC | - | **G[9:11] : Gamma Decoder for GMA4** |
| 20, 21 | DMY | LL | Lower 2bits of the embedded clock |

<DATA_START>

| Bit # | Name | Default | Function |
|---|---|---|---|
| 0, 1 | CK | HH | Higher 2bits of the embedded clock |
| 2 ~ 7 | DATA_START | HL HL HL | Indicates the next packet is the control packet |
| 8 ~ 10 | GMA_DEC | - | **G[12:14] : Gamma Decoder for GMA5** |
| 11 ~ 13 | GMA_DEC | - | **G[15:17] : Gamma Decoder for GMA6** |
| 14 ~ 16 | GMA_DEC | - | **G[18:20] : Gamma Decoder for GMA7** |
| 17 ~ 19 | GMA_DEC | - | **G[21:23] : Gamma Decoder for GMA8** |
| 20, 21 | DMY | LL | Lower 2bits of the embedded clock |

<CTR 1>

| Bit # | Name | Default | Function |
|---|---|---|---|
| 0, 1 | CK | HH | Higher 2bits of the embedded clock |
| 2 ~ 9 | SOE_START | - | 8 bits of the start point of SOE pulse |
| 10 ~ 13 | SOE_Width | - | 4 bits of the width of SOE pulse |
| 14 ~ 16 | GMA_DEC | - | **G[15:17] : Gamma Decoder for GMA9** |
| 17 ~ 19 | GMA_DEC | - | **G[27:29] : Gamma Decoder for GMA10** |
| 20, 21 | DMY | LL | Lower 2bits of the embedded clock |

FIG. 12

< HIGH GMA range >

| | Input data | G[2:0] | Gamma |
|---|---|---|---|
| GMA1 | 7 | 1 1 1 | 0.00% |
| | 6 | 1 1 0 | 0.50% |
| | 5 | 1 0 1 | 1.00% |
| | 4 | 1 0 0 | 1.60% |
| | 3 | 0 1 1 | 2.00% |
| | 2 | 0 1 0 | 2.50% |
| | 1 | 0 0 1 | 3.00% |
| | 0 | 0 0 0 | 3.50% |
| GMA2 | 7 | 1 1 1 | 0.80% |
| | 6 | 1 1 0 | 1.80% |
| | 5 | 1 0 1 | 2.80% |
| | 4 | 1 0 0 | 3.80% |
| | 3 | 0 1 1 | 4.80% |
| | 2 | 0 1 0 | 5.80% |
| | 1 | 0 0 1 | 6.80% |
| | 0 | 0 0 0 | 7.80% |
| GMA3 | 7 | 1 1 1 | 35.50% |
| | 6 | 1 1 0 | 39.00% |
| | 5 | 1 0 1 | 42.50% |
| | 4 | 1 0 0 | 46.00% |
| | 3 | 0 1 1 | 49.50% |
| | 2 | 0 1 0 | 53.00% |
| | 1 | 0 0 1 | 56.50% |
| | 0 | 0 0 0 | 60.00% |
| GMA4 | 7 | 1 1 1 | 61.00% |
| | 6 | 1 1 0 | 64.50% |
| | 5 | 1 0 1 | 68.00% |
| | 4 | 1 0 0 | 71.50% |
| | 3 | 0 1 1 | 75.00% |
| | 2 | 0 1 0 | 78.50% |
| | 1 | 0 0 1 | 82.00% |
| | 0 | 0 0 0 | 85.50% |
| GMA5 | 7 | 1 1 1 | 79.00% |
| | 6 | 1 1 0 | 82.00% |
| | 5 | 1 0 1 | 85.00% |
| | 4 | 1 0 0 | 88.00% |
| | 3 | 0 1 1 | 91.00% |
| | 2 | 0 1 0 | 94.00% |
| | 1 | 0 0 1 | 97.00% |
| | 0 | 0 0 0 | 100.00% |

< LOW GMA range >

| | Input data | G[2:0] | Gamma |
|---|---|---|---|
| GMA6 | 7 | 1 1 1 | 100.00% |
| | 6 | 1 1 0 | 99.00% |
| | 5 | 1 0 1 | 98.00% |
| | 4 | 1 0 0 | 97.00% |
| | 3 | 0 1 1 | 96.00% |
| | 2 | 0 1 0 | 95.00% |
| | 1 | 0 0 1 | 94.00% |
| | 0 | 0 0 0 | 93.00% |
| GMA7 | 7 | 1 1 1 | 88.50% |
| | 6 | 1 1 0 | 86.50% |
| | 5 | 1 0 1 | 84.50% |
| | 4 | 1 0 0 | 82.50% |
| | 3 | 0 1 1 | 80.50% |
| | 2 | 0 1 0 | 78.50% |
| | 1 | 0 0 1 | 76.50% |
| | 0 | 0 0 0 | 74.50% |
| GMA8 | 7 | 1 1 1 | 63.00% |
| | 6 | 1 1 0 | 61.00% |
| | 5 | 1 0 1 | 59.00% |
| | 4 | 1 0 0 | 57.00% |
| | 3 | 0 1 1 | 55.00% |
| | 2 | 0 1 0 | 53.00% |
| | 1 | 0 0 1 | 51.00% |
| | 0 | 0 0 0 | 49.00% |
| GMA9 | 7 | 1 1 1 | 7.80% |
| | 6 | 1 1 0 | 6.80% |
| | 5 | 1 0 1 | 5.80% |
| | 4 | 1 0 0 | 4.80% |
| | 3 | 0 1 1 | 3.80% |
| | 2 | 0 1 0 | 2.80% |
| | 1 | 0 0 1 | 1.80% |
| | 0 | 0 0 0 | 0.80% |
| GMA10 | 7 | 1 1 1 | 3.50% |
| | 6 | 1 1 0 | 3.00% |
| | 5 | 1 0 1 | 2.50% |
| | 4 | 1 0 0 | 2.00% |
| | 3 | 0 1 1 | 1.50% |
| | 2 | 0 1 0 | 1.00% |
| | 1 | 0 0 1 | 0.50% |
| | 0 | 0 0 0 | 0.00% |

FIG. 14

<CTR_START>

| Bit # | Name | Default | Function |
|---|---|---|---|
| 0, 1 | CK | HH | Higher 2bits of the embedded clock |
| 2 ~ 7 | CTR_START | HL HL HL | Indicates the next packet is the control packet |
| 8 ~ 11 | GMA_DEC | - | **G[0:3] : Gamma Decoder for GMA2** |
| 12 ~ 15 | GMA_DEC | - | **G[4:7] : Gamma Decoder for GMA3** |
| 16 ~ 19 | GMA_DEC | - | **G[8:11] : Gamma Decoder for GMA4** |
| 20, 21 | DMY | LL | Lower 2bits of the embedded clock |

<DATA_START>

| Bit # | Name | Default | Function |
|---|---|---|---|
| 0, 1 | CK | HH | Higher 2bits of the embedded clock |
| 2 ~ 7 | DATA_START | HL HL HL | Indicates the next packet is the control packet |
| 8 ~ 11 | GMA_DEC | - | **G[12:15] : Gamma Decoder for GMA7** |
| 12 ~ 15 | GMA_DEC | - | **G[16:19] : Gamma Decoder for GMA8** |
| 16 ~ 19 | GMA_DEC | - | **G[20:23] : Gamma Decoder for GMA9** |
| 20, 21 | DMY | LL | Lower 2bits of the embedded clock |

<CTR 1>

| Bit # | Name | Default | Function |
|---|---|---|---|
| 0, 1 | CK | HH | Higher 2bits of the embedded clock |
| 2 ~ 5 | SOE_START | - | 4 bits of the start point of SOE pulse |
| 6 ~ 9 | SOE_END | - | 4 bits of the end point of SOE pulse |
| 10, 11 | GMA_DEC | - | **G[24:25] : Gamma Decoder for GMA1** |
| 12 ~ 14 | GMA_DEC | - | **G[26:28] : Gamma Decoder for GMA5** |
| 15 ~ 17 | GMA_DEC | - | **G[29:31] : Gamma Decoder for GMA6** |
| 18, 19 | GMA_DEC | - | **G[32:33] : Gamma Decoder for GMA10** |
| 20, 21 | DMY | LL | Lower 2bits of the embedded clock |

LIQUID CRYSTAL DISPLAY DEVICE AND DRIVING METHOD THEREOF

This application claims the priority benefit of the Korean Patent Application No. 10-2011-0103767 filed on Oct. 11, 2011, and Korean Patent Application No. 10-2012-0101916 filed on Sep. 14, 2011, which is hereby incorporated by reference as if fully set forth herein.

BACKGROUND

1. Field of the Invention

The present disclosure relates to a liquid crystal display (LCD) device and a driving method thereof, in which the size of a printed circuit board (PCB) with a driving circuit mounted thereon is reduced and the manufacturing cost is saved.

2. Discussion of the Related Art

LCD devices have numerous advantages, for example, advanced manufacturing technology, good drivability of a driving means, low power consumption, high-quality images, and a large screen. Therefore, LCD devices are popular. Also, LCD devices are being applied to various fields such as portable computers including notebook computers, office automation equipment, portable multimedia equipment, indoor/outdoor display devices, etc., and the application fields of LCD devices are continuously expanding.

LCD devices adjust the light transmittances of respective pixels according to an input video signal, thereby displaying an image.

FIG. 1 is a diagram illustrating a related art LCD device. FIG. 2 is a diagram illustrating a connection structure between a gamma block and data driver integrated circuit (IC) of the related art.

Referring to FIGS. 1 and 2, the related art LCD device includes a liquid crystal panel 10 that displays an image by using an input image signal, a backlight unit (not shown) that supplies light to the liquid crystal panel 10, and a driving circuit that drives the liquid crystal panel 10.

The liquid crystal panel 10 includes an upper substrate (color filter array substrate), a lower substrate (thin film transistor (TFT) array substrate), and a liquid crystal layer formed between the upper substrate and the lower substrate. The liquid crystal panel 10 includes a plurality of pixels that are arranged in a matrix type, and adjusts the transmittance of light irradiated from the backlight unit to display an image.

The driving circuit includes a gate driver (not shown), a data driver (not shown), a gamma voltage generator 40, a timing controller 50, and a power supply (not shown).

Here, a plurality of data driver ICs 20, the gamma voltage generator 40, and the timing controller 50 are mounted on a PCB 30.

The gate driver includes a plurality of gate driver ICs, and sequentially supplies a scan signal to a plurality of gate lines formed in the liquid crystal panel 10 to switch on the plurality of pixels.

The data driver includes the data driver ICs 20, and respectively supplies data voltages to a plurality of data lines formed in the liquid crystal panel 10.

Here, the data driver ICs 20 convert digital image data, supplied from the timing controller 50, into analog data voltages and supply the analog data voltages to the data lines, respectively.

The timing controller 50 aligns digital image data inputted from the outside and supplies the aligned data to the data driver ICs 20.

Moreover, the timing controller 50 generates a plurality of control signals for controlling the gate driver and the data driver, and supplies the control signals to the gate driver and the data driver, respectively.

As illustrated in FIG. 2, the gamma voltage generator 40 includes a plurality of gamma blocks 42, and respectively generates a plurality of gamma voltages to the data driver ICs 20.

A capacitor (not shown), which buffers a gamma voltage and outputs a certain voltage value, is disposed in an output terminal of each of the gamma blocks 42.

In FIG. 2, as an example, the gamma voltage generator 40 is illustrated as including ten gamma blocks 42. Each of the gamma blocks 42 includes two resistors that are connected serially between a driving voltage VDD terminal and a ground voltage GND terminal.

The gamma blocks 42 generate a first gamma voltage GMA1 to a tenth gamma voltage GMA10 (which have different values) by using two corresponding resistors that are connected serially between the driving voltage VDD terminal and the ground voltage GND terminal, respectively. Furthermore, the gamma blocks 42 supply the first gamma voltage GMA1 to the tenth gamma voltage GMA10 to the data driver ICs 20, respectively.

Here, the data driver ICs 20 convert the digital image data outputted from the timing controller 50 into the analog data voltages by using positive and negative gamma voltages GMA1 to GMA10 supplied from the gamma voltage generator 40.

A plurality of transmission lines 60 are formed on the PCB 30, and the gamma voltage generator 40 and the data driver ICs 20 are connected in parallel through the transmission lines 60. The gamma voltages GMA1 to GMA10 generated by the gamma voltage generator 40 are supplied to the data driver ICs 20 through the transmission lines 60.

In the related art LCD device having the above-described configuration, when the gamma voltage generator 40 is configured with ten gamma blocks 42, the plurality of transmission lines 60 are required to be formed on the PCB 30 for parallelly connecting the ten gamma blocks 42 and the data driver ICs 20.

Since the transmission lines 60 are formed on the PCB 30, the area of the PCB 30 increases. Due to this reason, much research is being recently conducted for reducing the area of the PCB 30 on which the driving circuit of the LCD device is mounted. However, since the transmission lines 60 are formed on the PCB 30, there is a limitation in decreasing the area of the PCB 30.

Moreover, a method of reducing the layer of a PCB is proposed for saving the manufacturing cost of LCD devices, but since the transmission lines 60 are formed on the PCB 30, there is a limitation in decreasing the layer of the PCB 30.

Moreover, twenty resistors R1 to R20 are required for generating the first gamma voltage GMA1 to the tenth gamma voltage GMA10 by using the ten gamma blocks 42, and ten capacitors are disposed in respective output terminals of the gamma blocks 42, causing the increase in the manufacturing cost of LCD devices.

BRIEF SUMMARY

An LCD device includes: a plurality of data driver ICs including a gamma voltage generator which generates a gamma voltage; a timing controller that generates an EPI packet for controlling the data driver ICs; an EEPROM that stores packet data for controlling the gamma voltage; a power supply that generates a driving voltage; a reference voltage generator that reduces the driving voltage, and supplies the reduced driving voltage to the data driver ICs; and a PCB, the reference voltage generator, the data driver ICs, and the timing controller being mounted on the PCB, wherein a first transmission line which connects the reference voltage generator and the data driver ICs, and a second transmission line which connects the timing controller and the data driver ICs are formed on the PCB.

In another aspect of the present invention, there is provided a driving method of an LCD device, including: a plurality of data driver ICs including a gamma voltage generator which generates a gamma voltage; and a timing controller generating an EPI packet for controlling the data driver ICs, including: generating an EPI packet including a plurality of control signals for controlling the data driver ICs, a plurality of gamma control signals for controlling the gamma voltage, and RGB image data; supplying the EPI packet to the data driver ICs; converting the RGB image data into analog data voltages by using the gamma control signals included in the EPI packet; and supplying the data voltages to a liquid crystal panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 5 is a diagram illustrating an embedded point to point interface (EPI) packet according to an embodiment of the present invention;

FIG. 6 is a waveform diagram of the EPI packet of an LCD device according to an embodiment of the present invention;

FIG. 7 is a diagram illustrating an EPI packet according to another embodiment of the present invention;

FIG. 8 is a diagram illustrating examples of sub-packets included in the EPI packet of FIG. 7;

FIG. 12 is a diagram illustrating the ranges of the gamma voltages generated by the gamma voltage generator according to an embodiment of the present invention;

FIG. 14 is a diagram illustrating other examples of sub-packets included in the EPI packet of FIG. 7.

DETAILED DESCRIPTION OF THE DRAWINGS AND THE PRESENTLY PREFERRED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, an LCD device according to embodiments of the present invention will be described in detail with reference to the accompanying drawings.

LCD devices have been variously developed in the twisted nematic (TN) mode, the vertical alignment (VA) mode, the in-plane switching (IPS) mode, and the fringe field switching (FFS) mode according to schemes of adjusting the arrangement of a liquid crystal layer.

Among the modes, the IPS mode and the FFS mode are modes in which a plurality of pixel electrodes and common electrodes are arranged on a lower substrate, and the arrangement of the liquid crystal layer is adjusted by an electric field generated by a voltage difference between a corresponding pixel electrode and common electrode.

Especially, the IPS mode is a mode in which a pair of pixel electrode and common electrode are arranged parallelly and alternately, and a lateral electric field is generated by a voltage difference between the pixel electrode and the common electrode, thereby adjusting the arrangement of the liquid crystal layer.

In the IPS mode, the arrangement of the liquid crystal layer is not adjusted in an upper portion over the pixel electrode and the common electrode, and thus, light transmittance decreases in an area corresponding to the upper portion.

To overcome the limitations of the IPS mode, the FFS mode has been developed. In the FFS mode, a pixel electrode and a common electrode are formed apart from each other with an insulating layer therebetween.

In this case, one electrode is formed in a plate shape or a pattern, and the other electrode is formed in a finger shape, thereby adjusting the arrangement of the liquid crystal layer with a fringe field generated between two electrodes.

The TN mode, the VA mode, the IPS mode, and the FFS mode may be selectively applied to the LCD device according to embodiments of the present invention.

Figure 1:
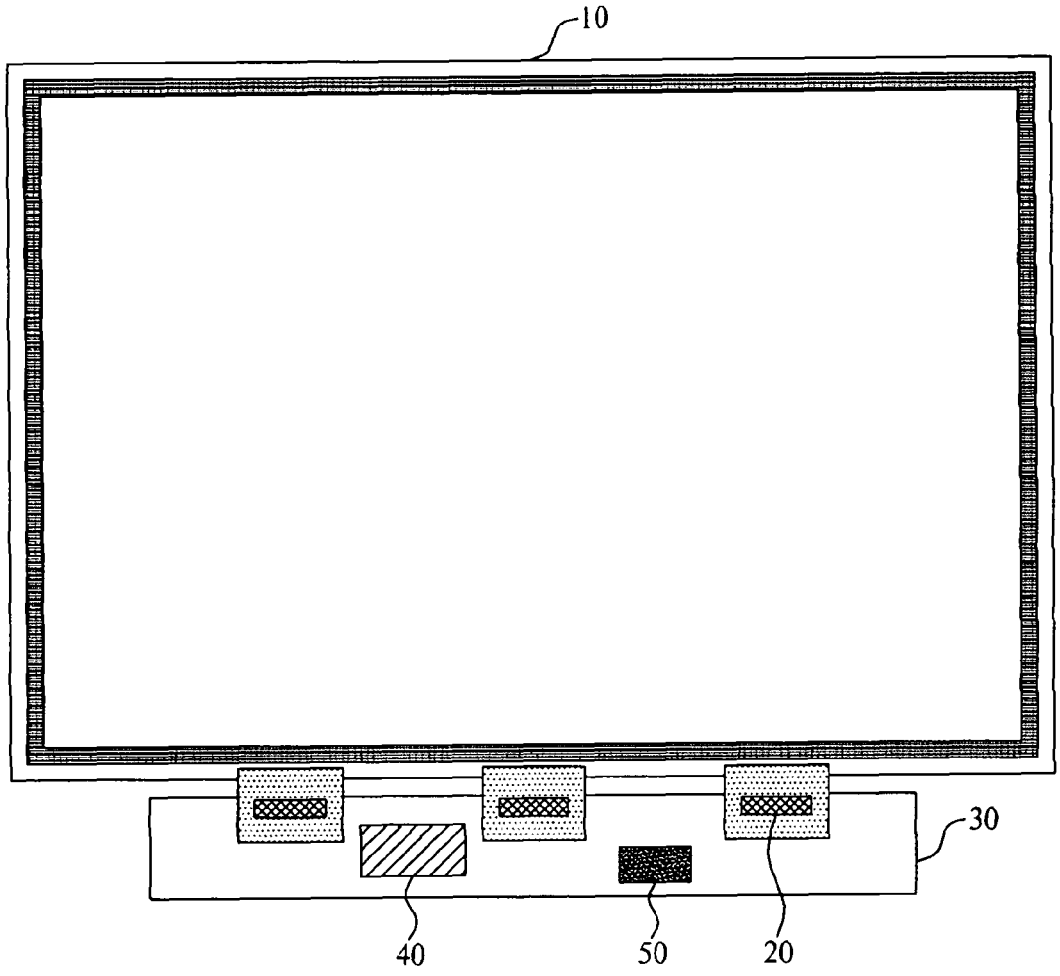
FIG. 1 is a diagram illustrating a related art LCD device.
Figure 2:
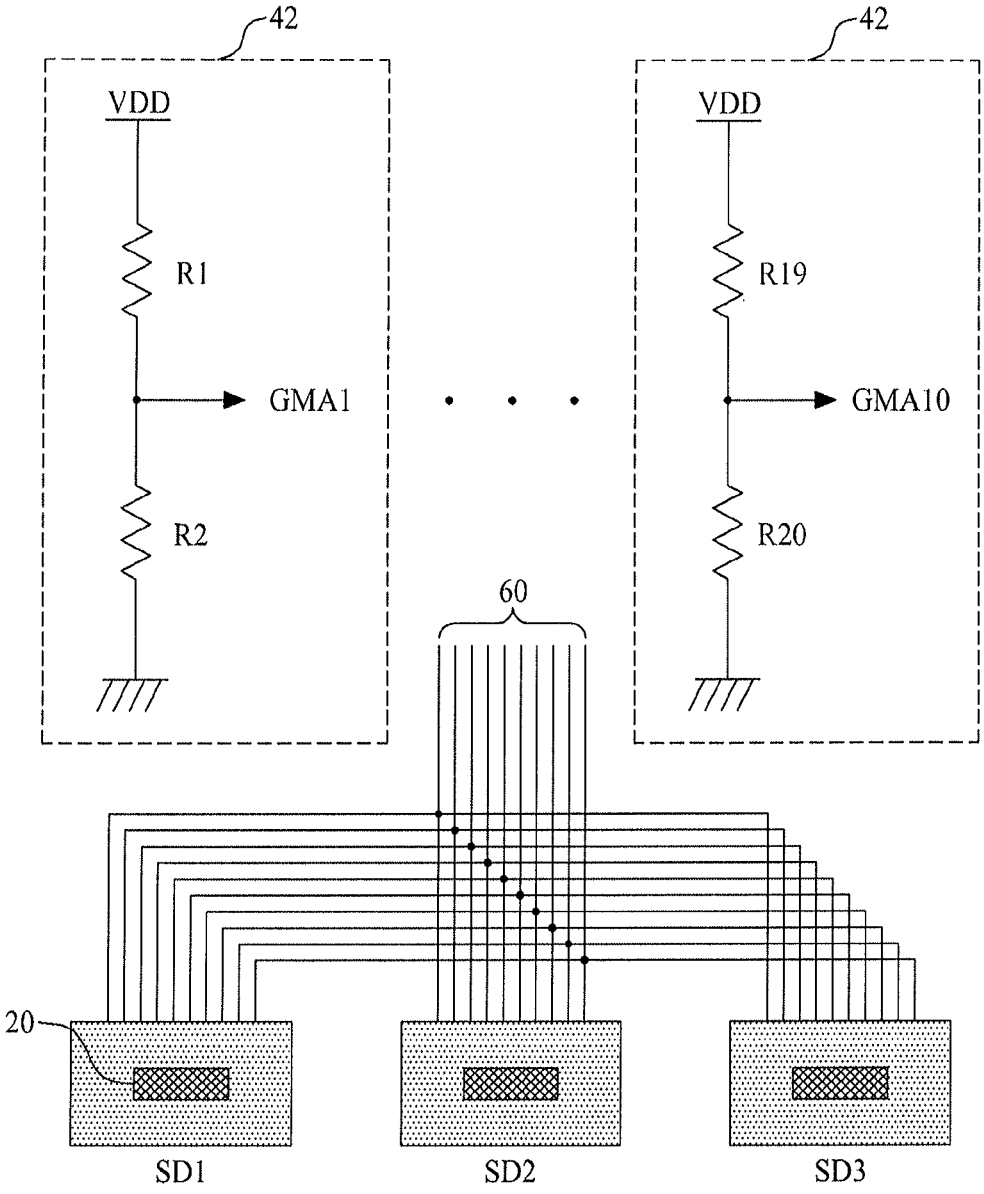
FIG. 2 is a diagram illustrating a connection structure between a gamma block and data driver IC of the related art.
Figure 3:
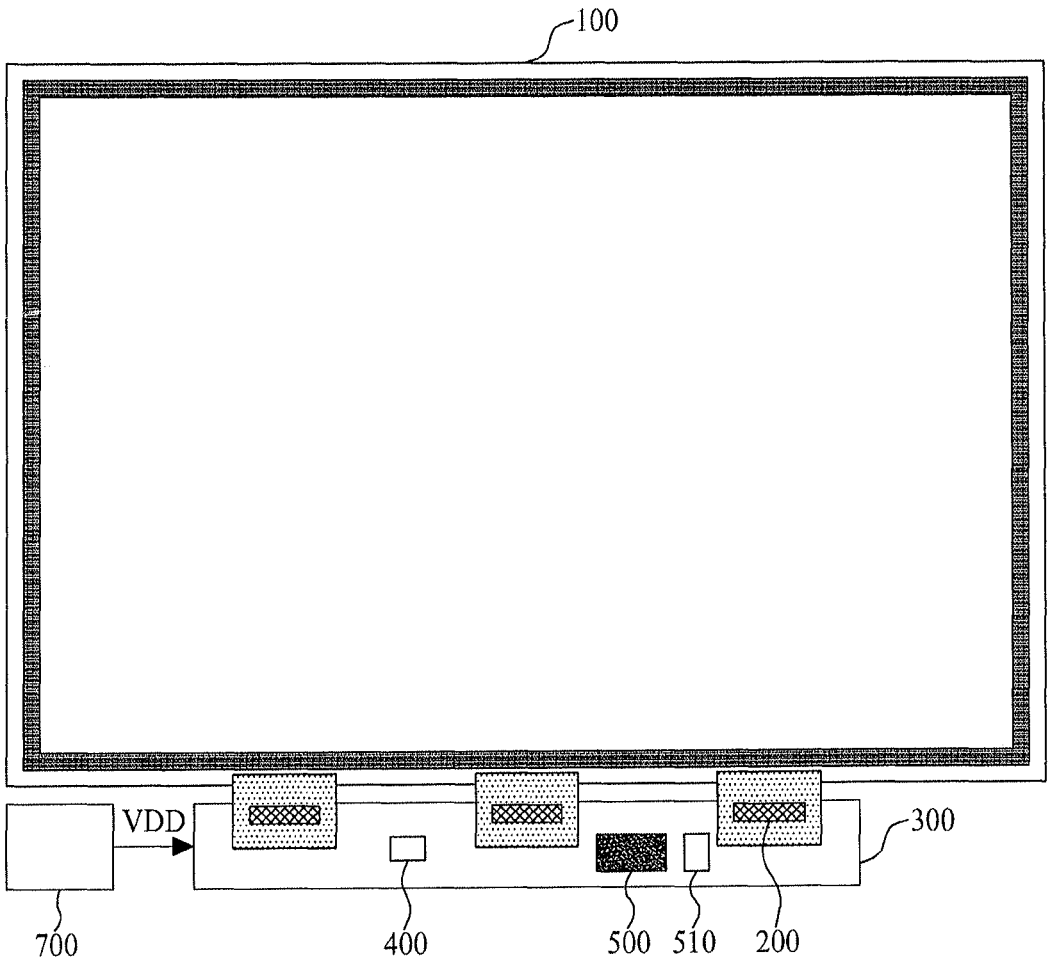
FIG. 3 is a diagram illustrating an LCD device according to an embodiment of the present invention.
Figure 4:
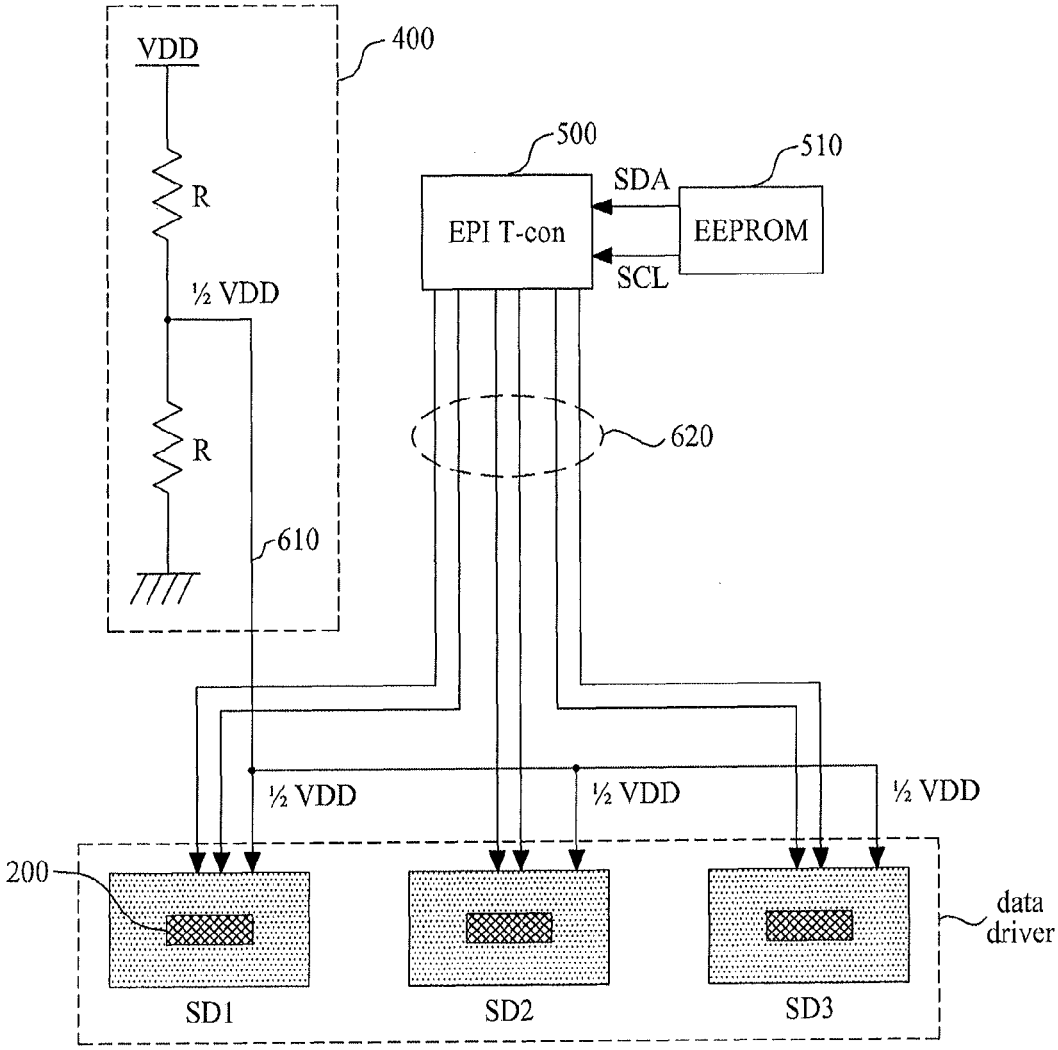
FIG. 4 is a diagram illustrating a connection structure between a reference voltage generator and a data driver IC and a connection structure between a timing controller and a data driver IC, according to a first embodiment of the present invention.

FIG. 3 is a diagram illustrating an LCD device according to an embodiment of the present invention. FIG. 4 is a diagram illustrating a connection structure between a reference voltage generator and data driver IC and a connection structure between a timing controller and a data driver IC, according to a first embodiment of the present invention.

Referring to FIGS. 3 and 4, the LCD device according to an embodiment of the present invention includes a liquid crystal panel 100 that displays an image, a backlight unit that supplies light to the liquid crystal panel 100, and a driving circuit.

The liquid crystal panel 100 includes an upper substrate (color filter array substrate), a lower substrate (TFT array substrate), and a liquid crystal layer formed between the upper substrate and the lower substrate. The liquid crystal panel 100 includes a plurality of gate lines and data lines that are formed to intersect each other, and a plurality of pixels are defined by the gate lines and the data lines.

The plurality of pixels are arranged in a matrix type. A TFT being a switching element, a storage capacitor, a pixel electrode, and a common electrode are formed in each of the pixels.

Here, as in the TN mode and the VA mode, when an image is displayed with a vertical electric field, a plurality of common electrodes are formed on an upper substrate.

As in the IPS mode and the FFS mode, when an image is displayed with a lateral electric field or a fringe field, the common electrodes are formed on a lower substrate.

The pixels adjust transmittance of light irradiated from the backlight unit according to electric fields generated by data voltages respectively supplied to the pixel electrodes and a common voltage (Vcom) supplied to the common electrodes, thereby displaying an image.

The backlight unit includes a light source that emits light supplied to the liquid crystal panel 100, and a plurality of optical members for enhancing light efficiency.

A cold cathode fluorescent lamp (CCFL), an external electrode fluorescent lamp (EEFL), or a light emitting diode (LED) may be applied as the light source.

The optical members may include a light guide panel (LGP), a diffusive film, a prism sheet, and a dual brightness enhancement film (FBEF).

The driving circuit includes a gate driver, a data driver, an EPI timing controller 500, a reference voltage generator 400, and a power supply 700 that supplies a driving voltage VDD to the driving circuit.

Here, the data driver includes a plurality of data driver ICs 200.

The data driver ICs 200, the reference voltage generator 400, and the EPI timing controller 500 are mounted on a PCB 300.

Moreover, a first transmission line (reference voltage transmission line) 610 that connects the reference voltage generator 400 and the data driver ICs 200, and a second transmission line (EPI packet transmission line) 620 that connects the EPI timing controller 500 and the data driver ICs 200 are formed on the PCB 300.

An electrically erasable programmable read-only memory (EEPROM) 510 stores packet data for controlling a plurality of gamma voltages GMA.

The EPI timing controller 500 supplies packet information (i.e., EPI packet), including a plurality of control signals for controlling the data driver and RGB image data, to the data driver. The EPI timing controller 500 is connected to the data driver ICs 200 through the second transmission line 620 in a point-to-point type. The EPI timing controller 500 is connected to the EEPROM 510 that is a memory element, and receives the packet data from the EEPROM 510.

Here, the EPI timing controller 500 and the EEPROM 510 are connected through an I2C interface, and the EPI timing controller 500 loads packet data stored in the EEPROM 510. The EPI timing controller 500 generates a gamma control signal with the loaded packet data.

Hereinafter, an EPI packet generated by the EPI timing controller 500 will be described with reference to FIGS. 5 to 8.

In the present embodiment, the EPI timing controller 500 adds a plurality of gamma control signals (which are used for generating a first gamma voltage GMA1 to a tenth gamma voltage GMA10) into the EPI packet, and transfers the EPI packet to the data driver ICs 200.

FIG. 5 is a diagram illustrating an embedded point to point interface (EPI) packet according to an embodiment of the present invention. FIG. 6 is a waveform diagram of the EPI packet of an LCD device according to an embodiment of the present invention.

An EPI packet according to an embodiment of the present invention illustrated in FIG. 5 includes packet data (i.e., a gamma control packet CTR0) for controlling a gamma voltage.

Referring to FIGS. 5 and 6, the EPI timing controller 500 generates the EPI packet including a plurality of control signals for controlling the gate driver and the data driver and digital image data, and supplies the EPI packet to the data driver. Also, the EPI timing controller 500 supplies a control signal for controlling the gate driver to the gate driver.

The EPI timing controller 500 aligns digital image data inputted from the outside, configures the digital image data into an RGB_DATA packet, and adds the digital image data into the EPI packet. The EPI timing controller 500 supplies the EPI packet to the data driver ICs 200 through the second transmission line (EPI packet transmission line) 620.

Moreover, the EPI timing controller 500 generates the gamma control packet CTR0 for generating a gamma voltage by using the packet data stored in the EEPROM 510, and adds the generated gamma control packet CTR0 into the EPI packet. The EPI timing controller 500 supplies the EPI packet including the gamma control packet CTR0 to the data drive ICs 200 through the second transmission line (EPI packet transmission line) 620.

Here, the gamma control packet CTR0 is a control signal for generating the first gamma voltage GMA1 to the tenth gamma voltage GMA10 that are used when the data driver converts digital image data into analog data voltages.

Here, the EPI packet is configured with a plurality of packets, and each of the packets may be configured with a certain number of bits, for example, may be configured to have a size of 22 bits.

The packets include a preamble packet, a control start packet CTR_START, a plurality of control packets CTR0 to CTR2, a data start packet DATA_START, and image data packet RGB_DATA. The packets configure one EPI packet.

The control signals includes a preamble signal for initializing the data driver ICs 200, a clock CLK, an EPI packet start indication signal CTR_START, a data enable signal DE, a source output enable signal SOE, a source output width signal SOE, a polarity signal POL, a gate start pulse signal GSP, gamma buffer enable signals GMAENB1 and GMAENB2, an image data start signal DATA_START, and a gamma control signal.

The preamble signal is encoded into the preamble packet, and the other signals are encoded into the control packets CTR0 to CTR2 and supplied to the data driver ICs 200, respectively.

In particular, the gamma control signal for generating the first gamma voltage GMA1 to the tenth gamma voltage GMA10 generated by the data driver ICs 200 are encoded into a separate gamma control packet CTR0 and thus added into the EPI packet.

The image data is configured with RGB image data. The RGB image data are serially encoded into a 22-bit RGB_DATA packet, and supplied to the data driver ICs 200.

FIG. 7 is a diagram illustrating an EPI packet according to another embodiment of the present invention. FIG. 8 is a diagram illustrating examples of sub-packets included in the EPI packet of FIG. 7.

Referring to FIGS. 7 and 8, the EPI packet according to another embodiment of the present invention may be configured with a plurality of packets, and each of the packets may be configured with a certain number of bits, for example, may be configured to have a size of 22 bits.

The packets include an EPI start packet EPI_START indicating the start of the EPI packet, a control start packet CTR_START, a plurality of control packets CTR1 and CTR2, a data start packet DATA_START, and image data packet RGB_DATA. The packets configure one EPI packet.

Here, each of the control start packet CTR_START, the control packets CTR1 and CTR2, and the data start packet DATA_START may be composed of 22 bits. In addition to bits into which signals included in the respective packets are encoded, there are residual bits.

Therefore, in another embodiment of the present invention, the respective packets include unique signals, and a plurality of gamma control signals for generating the first gamma voltage GMA1 to the tenth gamma voltage GMA10 generated by the data driver ICs 200 may be encoded into the residual bits.

As illustrated in FIG. 8, a gamma control signal for generating the first gamma voltage GMA1 to the fourth gamma voltage GMA4 may be encoded into the residual bits of the control start packet CTR_START.

A gamma control signal for generating the fifth gamma voltage GMA5 to the eighth gamma voltage GMA8 may be encoded into the residual bits of the data start packet DATA_START.

A gamma control signal for generating the ninth gamma voltage GMA9 and the tenth gamma voltage GMA10 may be encoded into the residual bits of a first control packet CTR1.

In this way, the gamma control signals for generating the first gamma voltage GMA1 to the tenth gamma voltage GMA10 may be distributed to and encoded into the packets configuring the EPI packet, and the EPI packet including the gamma control signals may be transferred to the data driver ICs 200.

Referring again to FIG. 4, the reference voltage generator 400 includes two resistors R having the same resistance value, and the driving voltage VDD is dropped by half through the two resistors.

The reference voltage generator 400 drops the driving voltage VDD (which is supplied from the power supply 700) by half to generate a reference voltage for increasing the accuracy of the gamma voltages, and supplies the reference voltage (VDD/2) to the data driver ICs 200 through the first transmission line (reference voltage transmission line) 610.

The gate driver includes a plurality of gate driver ICs, and generates a scan signal on the basis of the EPI packet supplied form the EPI timing controller 500. Subsequently, the gate driver sequentially supplies the scan signal to the gate lines that are formed in the liquid crystal panel 100, thereby switching on the plurality of pixels.

The data driver includes the data driver ICs 200, and supplies analog image data (i.e., data voltages) to the data lines that are formed in the liquid crystal panel 100.

In this case, the data driver ICs 200 convert digital image data into analog data voltages on the basis of the EPI packet supplied from the EPI timing controller 500, and supply the data voltages to the data lines of the liquid crystal panel 100.

Figure 9:
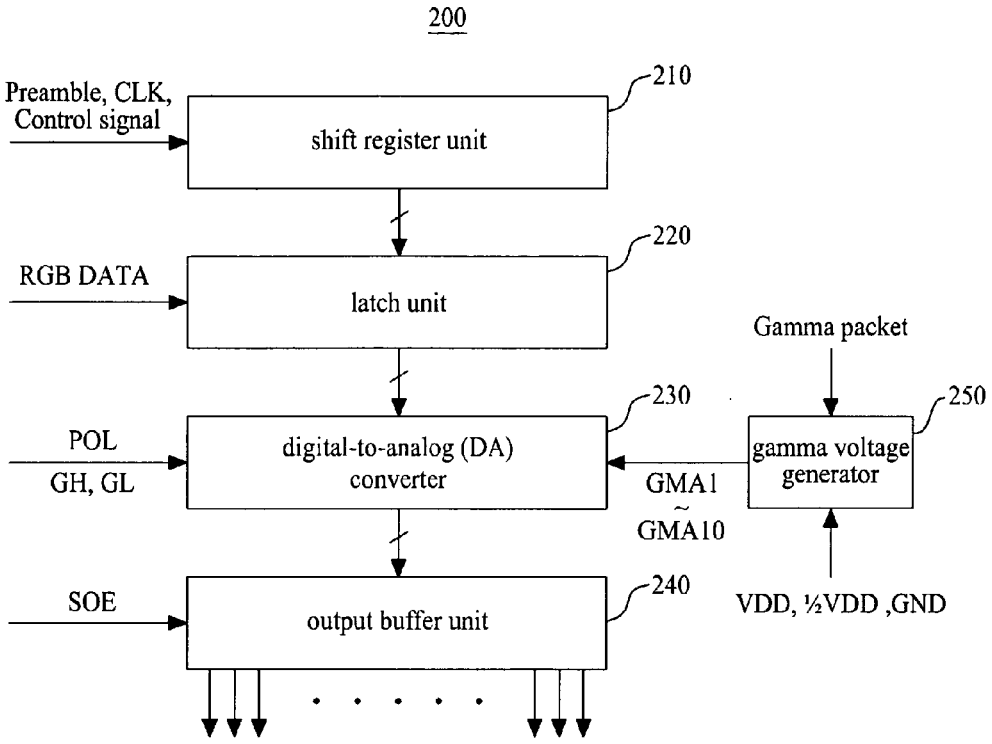
FIG. 9 is a diagram illustrating a data driver IC of an LCD device according to an embodiment of the present invention.

FIG. 9 is a diagram illustrating a data driver IC of an LCD device according to an embodiment of the present invention.

Referring to FIG. 9, each of the data driver ICs 200 includes: a shift register unit 210 that sequentially supplies a sampling signal; a latch unit 220 that sequentially latches digital data and simultaneously output the latched digital data in response to the sampling signal; a digital-to-analog (DA) converter 230 that converts the digital image data from the latch unit 220 into analog image data, namely, data voltages; and an output buffer unit 240 that buffers and outputs the analog data from the DA converter 230.

Moreover, the data driver ICs 200 convert digital image data into analog data voltages by using the gamma voltage GMA.

Figure 10:
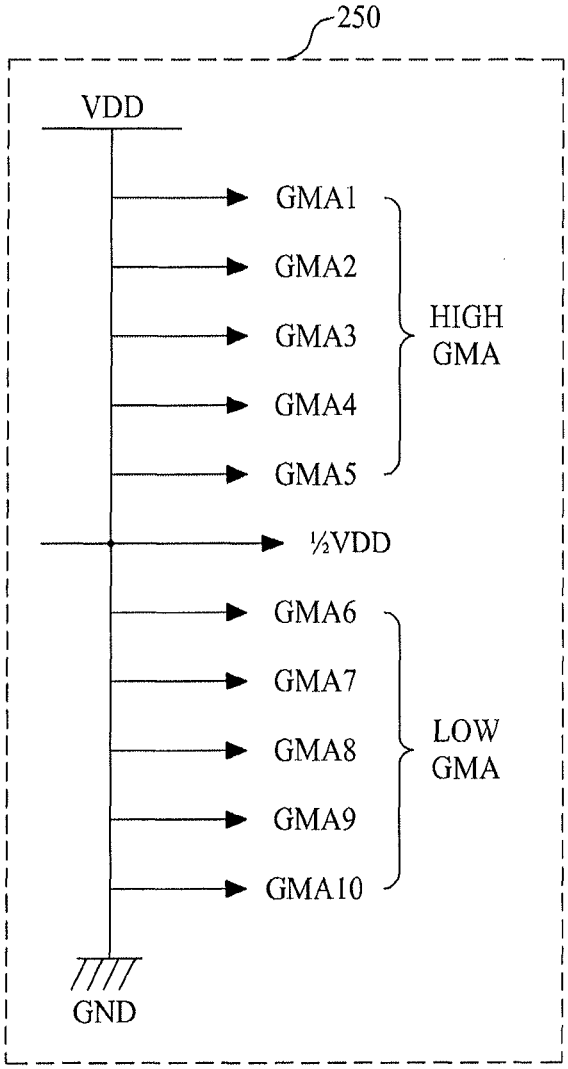
FIG. 10 is a diagram illustrating a gamma voltage generator of an LCD device according to an embodiment of the present invention.
Figure 11:
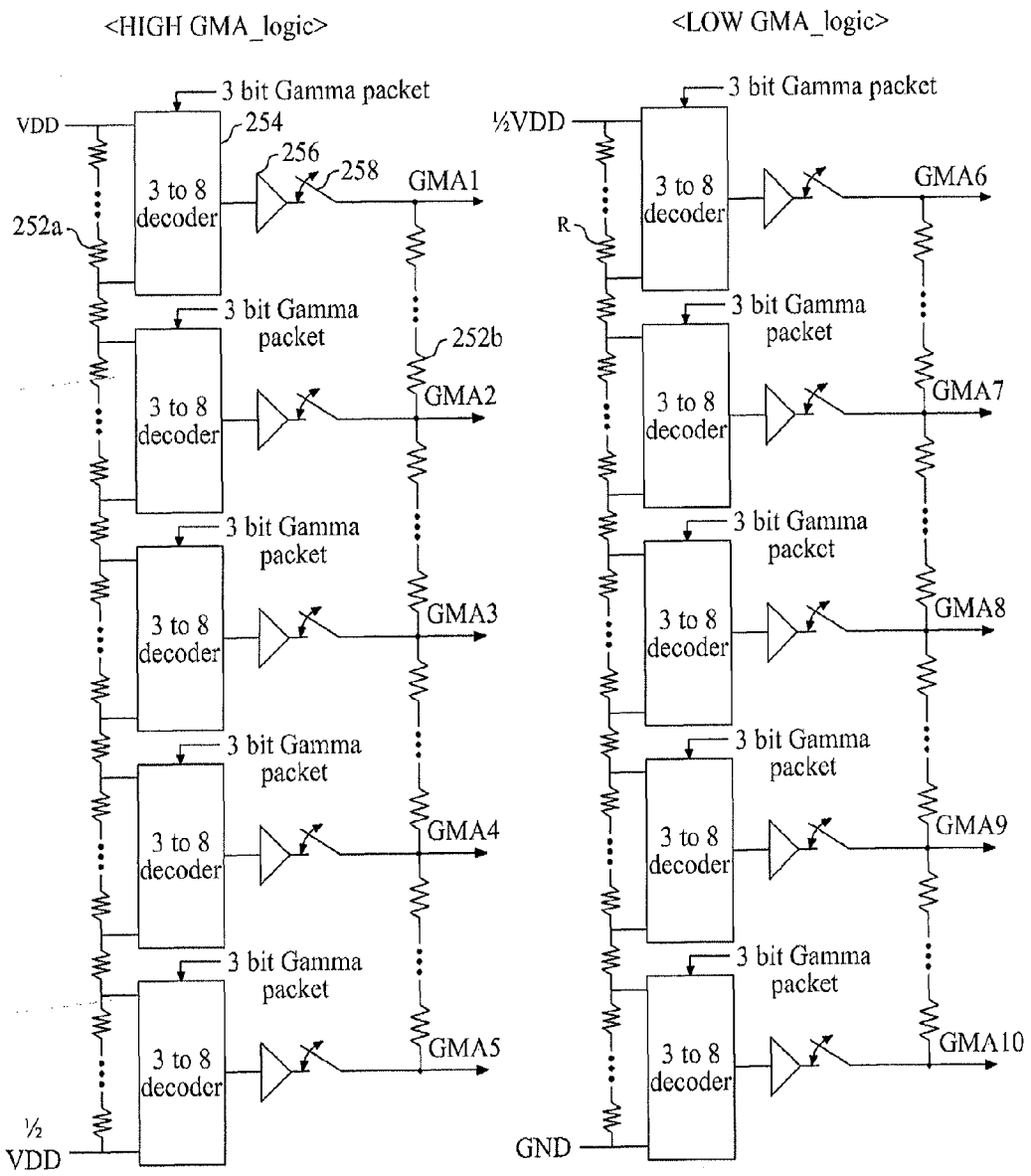
FIG. 11 is a diagram for describing a detailed configuration of the gamma voltage generator of FIG. 10 and a method of generating gamma voltages.

To this end, as illustrated in FIGS. 10 and 11, the data driver ICs 200 includes the gamma voltage generator 250 for generating the gamma voltage GMA that is used in converting the digital image data into data voltages.

Each of the data driver ICs 200 having the above-described configuration supplies data voltages to a certain number of data lines that are grouped among n number of data lines formed in the liquid crystal panel 100.

n number of shift registers included in the shift register unit 210 shift a source start pulse SSP sequentially according to a source sampling clock signal SSC to output the sampling signal.

The latch unit 220 sequentially samples and latches the digital image data by certain unit, in response to the sampling signal from the shift register unit 210.

To this end, the latch unit 220 includes n number latches for latching n number of digital image data. Each of the latches has a size corresponding to the number of bits of digital image data.

Here, the EPI timing controller 500 may divide digital image data into even data and odd data and simultaneously output the even data and the odd data through the second transmission line 620, for reducing a transmission frequency.

Each of the even data and odd data includes red (R), green (G), and blue (B) data. Therefore, the latch unit 220 may latch the even data and odd data (i.e., six digital data) supplied for each sampling signal.

The DA converter 230 converts digital data from the latch unit 220 into positive and negative analog data and outputs the positive and negative analog data simultaneously. To this end, the DA converter 230 includes a positive (P) decoder (not shown) and a negative (N) decoder (not shown) that are connected to the latch unit 220 in common, and a multiplexer (MUX, not shown) for selecting an output signal of the P decoder and an output signal of the N decoder.

The DA converter 230 converts digital image data into positive data voltages by using a plurality of positive gamma voltages GMA1 to GMA5 from the gamma voltage generator 250.

Moreover, the DA converter 230 converts digital image data into negative data voltages by using a plurality of negative gamma voltages GMA6 to GMA10 from the gamma voltage generator 250.

n number of output buffers included in the output buffer unit 240 are configured with a plurality of voltage followers that is serially connected to n number of data lines D1 to Dn, respectively. The output buffers signal-buffer analog data from the DA converter 230, and supply the buffered analog data to the data lines D1 to Dn.

FIG. 10 is a diagram illustrating the gamma voltage generator of the LCD device according to an embodiment of the present invention. FIG. 11 is a diagram for describing a detailed configuration of the gamma voltage generator of FIG. 10 and a method of generating gamma voltages.

Referring to FIGS. 10 and 11, the gamma voltage generator 250 includes a plurality of resistors 252*a* and 252*b* that are serially connected between a driving voltage VDD terminal and a reference voltage VDD/2 terminal and between the reference voltage VDD/2 terminal and a ground voltage GND terminal.

The driving voltage VDD is supplied from the power supply 700, and the reference voltage VDD/2 is supplied from the reference voltage generator 400.

Here, the plurality of resistors 252*a* configure a resistor string formed in the data driver IC 200, and are serially connected to an input terminal. The plurality of resistors 252*b* configure a resistor string formed in the data driver IC 200, and are serially connected to an output terminal.

The first gamma voltage GMA1 to the tenth gamma voltage GMA10 that are divided into ten levels and have different voltage values are generated from respective nodes between a plurality of resistors according to a plurality of resistance values.

Moreover, the gamma voltage generator 250 includes a plurality of decoders 254 that are connected to respective nodes between a plurality of resistors, and selectively output one of a plurality of gamma voltages according to an input gamma control signal (gamma packet).

As an example, as illustrated in FIG. 11, the decoders 254 may selectively output one of eight outputs according to a 3-bit input.

A plurality of buffers 256 that buffer an output gamma voltage to output a certain voltage value are formed in respective output terminals of the decoders 254. A switch 258 is formed between each buffer 256 and the output terminal so as to enable the selective use of gamma voltages respectively outputted from the buffers 256

The gamma voltage generator 250 having the above-described configuration, as illustrated in FIGS. 5 to 8, generates the first gamma voltage GMA1 to the tenth gamma voltage GMA10 and supplies the first gamma voltage GMA1 to the tenth gamma voltage GMA10 to the DA converter 240 according to the gamma control signals included in the EPI packet.

As illustrated in FIG. 12, the first gamma voltage GMA1 to the tenth gamma voltage GMA10 may be subdivided into a certain number of bits and thus generated according to the gamma control signals included in the EPI packet.

Here, among the first gamma voltage GMA1 to the tenth gamma voltage GMA10, the first gamma voltage GMA1 to the fifth gamma voltage GMA5 are high gamma voltages for positive (+) data voltages. Among the first gamma voltage GMA1 to the tenth gamma voltage GMA10, the sixth gamma voltage GMA6 to the tenth gamma voltage GMA10 are low gamma voltages for negative (−) data voltages.

The gamma voltage generator 250 according to an embodiment of the present invention minutely set gamma voltages.

For example, when the driving voltage VDD is 7.6 V, the first gamma voltage GMA1 to the fifth gamma voltage GMA5 may be generated with a voltage of 3.8 V that is a difference voltage between the driving voltage VDD of 7.6 V and a reference voltage VDD/2 of 3.8 V.

Furthermore, the sixth gamma voltage GMA6 to the tenth gamma voltage GMA10 may be generated with a voltage of 3.8 V that is a difference voltage between the reference voltage VDD/2 of 3.8 V and the ground voltage GND of 0 V.

The data driver ICs 200 convert digital image data supplied from the EPI timing controller 500 into analog data voltages by using the first gamma voltage GMA1 to the tenth gamma voltage GMA10 generated by the gamma voltage generator 250. Furthermore, by supplying the first gamma voltage GMA1 to the tenth gamma voltage GMA10 to the plurality of data lines formed in the liquid crystal panel 100, the plurality of pixels display an image. Accordingly, the gamma voltages are minutely set, thus enhancing the display quality of images.

The range of each of the first gamma voltage GMA1 to the tenth gamma voltage GMA10 may be composed of a plurality of bits so as to minutely set the target values of the first gamma voltage GMA1 to the tenth gamma voltage GMA10.

As an example, the range of each of the first gamma voltage GMA1 to the tenth gamma voltage GMA10 may be composed of 3 bits.

When the range of each of the first gamma voltage GMA1 to the tenth gamma voltage GMA10 is composed of 3 bits, a gamma voltage is generated in units of 0.475 V as expressed in the following Equation (1), and thus, the target values of the first gamma voltage GMA1 to the tenth gamma voltage GMA10 can be minutely set.

$$7.6\text{V}(VDD)-3.8\text{V}(VDD/2)/8(3\text{ bits})=0.475\text{V} \quad (1)$$

As another example, the range of each of the first gamma voltage GMA1 to the tenth gamma voltage GMA10 may be composed of 8 bits.

When the range of each of the first gamma voltage GMA1 to the tenth gamma voltage GMA10 is composed of 8 bits, a gamma voltage is generated in units of 0.015 V as expressed in the following Equation (2), and thus, the target values of the first gamma voltage GMA1 to the tenth gamma voltage GMA10 can be minutely set.

$$7.6\text{V}(VDD)-3.8\text{V}(VDD/2)/256(8\text{ bits})=0.015\text{V} \quad (2)$$

Figure 13:
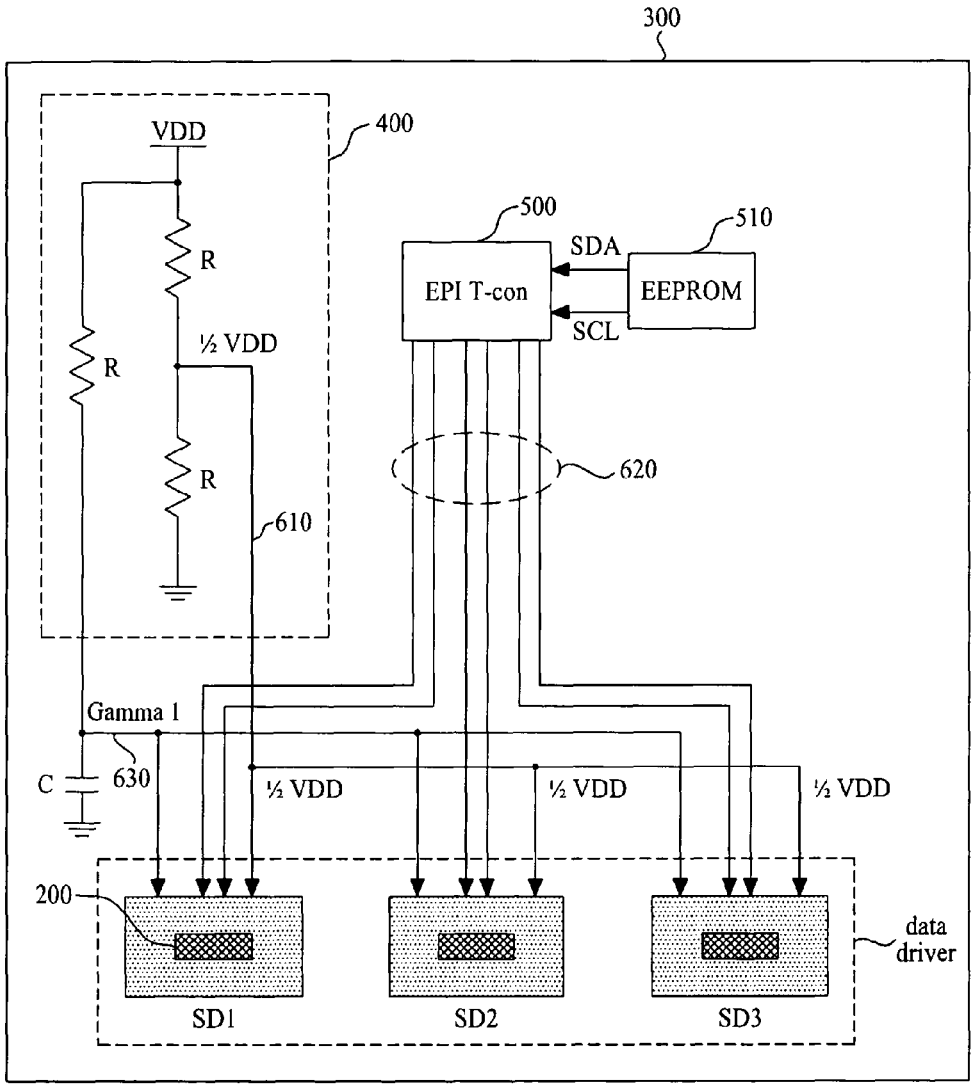
FIG. 13 is a diagram illustrating a connection structure between a reference voltage generator and a data driver IC and a connection structure between a timing controller and a data driver IC, according to a second embodiment of the present invention.

FIG. 13 is a diagram illustrating a connection structure between a reference voltage generator and a data driver IC and a connection structure between a timing controller and a data driver IC, according to a second embodiment of the present invention. In describing the second embodiment with reference to FIG. 13, a detailed description on the same elements as those of the first embodiment that have been described above with reference to FIG. 4 is not provided.

Referring to FIG. 13, a driving circuit includes a gate driver, a data driver, an EPI timing controller 500, a reference voltage generator 400, and a power supply 700. The data driver includes a plurality of data driver ICs 200.

The data driver ICs 200, the reference voltage generator 400, and the EPI timing controller 500 are mounted on the PCB 300.

Moreover, a first transmission line (reference voltage transmission line) 610 that connects the reference voltage generator 400 and the data driver ICs 200 is formed on the PCB 300. Also, a second transmission line (EPI packet transmission line) 620 that connects the EPI timing controller 500 and the data driver ICs 200 is formed on the PCB 300. Furthermore, a third transmission line (gamma voltage transmission line) 630 through which the first gamma voltage GMA1 generated by the reference voltage generator 400 is transmitted is formed on the PCB 300.

Here, the reference voltage generator 400 includes two resistors R having the same resistance value, and drops the driving voltage VDD by half with the two resistors.

To increase the accuracy of the gamma voltage, the reference voltage generator 400 drops the driving voltage (which is supplied from the power supply 700) by half to generate the reference voltage. Furthermore, the reference voltage generator 400 supplies the reference voltage VDD/2 to the data driver ICs 200 through the first transmission line (reference voltage transmission line) 610.

Moreover, the reference voltage generator 400 generates the first gamma voltage GMA1, and supplies the first gamma voltage GMA1 to the data driver ICs 200 through the third transmission line (gamma voltage transmission line) 630.

Each of the data driver ICs 200 generates the second gamma voltage GMA2 to the tenth gamma voltage GMA10 with respect to the first gamma voltage GMA1. Therefore, the reference voltage generator 400 supplies the first gamma voltage GMA1 to the data driver ICs 200, and thus enables the data driver ICs 200 to smoothly generate the second gamma voltage GMA2 to the tenth gamma voltage GMA10. Also, the first gamma voltage GMA1 to the tenth gamma voltage GMA10 can be generated as accurate gamma voltages.

Here, an RC filter is provided in an output terminal for the first gamma voltage GMA1, and thus decreases the ripple of the first gamma voltage GMA1, thereby enabling the first gamma voltage GMA1 having an accurate value to be supplied to the data driver ICs 200.

The EPI timing controller 500 supplies packet information (i.e., EPI packet), including a plurality of control signals for controlling the data driver and RGB image data, to the data driver.

The EPI timing controller 500 is connected to the data driver ICs 200 through the second transmission line 620 in a point-to-point type. The EPI timing controller 500 and the EEPROM 510 are connected through the I2C interface, and the EPI timing controller 500 loads packet data stored in the EEPROM 510. The EPI timing controller 500 generates a gamma-control signal with the loaded packet data.

FIG. 14 is a diagram illustrating other examples of sub-packets included in the EPI packet of FIG. 7.

Referring to FIG. 14, each of the control start packet CTR_START, the control packets CTR1 and CTR2, and the data start packet DATA_START may be composed of 22 bits. In addition to bits into which signals included in the respective packets are encoded, there are residual bits.

Therefore, in another embodiment of the present invention, unique signals are respectively included in the sub-packets included in the EPI packet, and the gamma control signals may be encoded into the residual bits.

The gamma control signals are added into the EPI packet, and supplied to the data driver ICs 200. Each of the data driver ICs 200 generates the second gamma voltage GMA2 to the tenth gamma voltage GMA10 with the voltages VDD, VDD/2, and GND and first gamma voltage GMA1 supplied from the reference voltage generator 400 according to the gamma control signal included in the EPI packet.

The data driver ICs 200 convert RGB image data, included in the EPI packet, into analog data voltages with the first gamma voltage GMA1 to the tenth gamma voltage GMA10, and supply the respective data voltages to a plurality of data lines formed in the liquid crystal panel 100.

Hereinafter, an example in which the gamma control signals are encoded into the residual bits of the sub-packets configuring the EPI packet will be described.

As illustrated in FIG. 14, in order to accurately set the first gamma voltage GMA1 to the tenth gamma voltage GMA10, the gamma control signals of the first gamma voltage GMA1 to the tenth gamma voltage GMA10 may be encoded into a plurality of bits.

A gamma control signal for generating the second gamma voltage GMA2 to the fourth gamma voltage GMA4 may be encoded into the residual bits of the control start packet CTR_START. In this case, the gamma control signal for generating the second gamma voltage GMA2 to the fourth gamma voltage GMA4 may be encoded into 4 bits.

A gamma control signal for generating the seventh gamma voltage GMA7 to the ninth gamma voltage GMA9 may be encoded into the residual bits of the data start packet DATA_START. In this case, the gamma control signal for generating the seventh gamma voltage GMA7 to the ninth gamma voltage GMA9 may be encoded into 4 bits.

Gamma control signals for generating the first gamma voltage GMA1, the fifth gamma voltage GMA5, the sixth gamma voltage GMA6, and the tenth gamma voltage GMA10 may be encoded into the residual bits of the first control packet CTR1. In this case, the gamma control signals for the first gamma voltage GMA1 and the tenth gamma voltage GMA10 may be encoded into 2 bits. The gamma control signals for the fifth gamma voltage GMA5 and the sixth gamma voltage GMA6 may be encoded into 3 bits.

Here, the numbers of bits into which the gamma control signals are encoded may differ according to the gamma voltage. The first gamma voltage GMA1 has a voltage value similar to the driving voltage VDD, and the tenth gamma voltage GMA10 has a voltage value similar to the ground voltage GND. Therefore, even though the gamma control signal is encoded into 2 bits, the first gamma voltage GMA1 and the tenth gamma voltage GMA10 may be generated as accurate voltage values, and thus, other gamma voltages may be encoded into fewer bits.

The residual bits, which are obtained by encoding the gamma control signals for the first gamma voltage GMA1 and the tenth gamma voltage GMA10 into 2 bits, may be used to encode a gamma control signal for the other gamma voltages.

The fifth gamma voltage GMA5 and the sixth gamma voltage GMA6 have a voltage value similar to the dropped voltage VDD/2. Therefore, even though the gamma control signal is encoded into 3 bits, the fifth gamma voltage GMA5 and the sixth gamma voltage GMA6 may be generated as accurate voltage values.

The seventh gamma voltage GMA7 to the ninth gamma voltage GMA9 have a voltage value between the driving voltage VDD and the ground voltage GND, and thus, in order for the seventh gamma voltage GMA7 to the ninth gamma voltage GMA9 to be generated as accurate voltage values, a gamma control signal for the other gamma voltages may be encoded into more bits (for example, 4 bits) compared to the seventh gamma voltage GMA7 to the ninth gamma voltage GMA9.

In this way, the gamma control signals for generating the first gamma voltage GMA1 to the tenth gamma voltage GMA10 may be distributed to and encoded in a plurality of packets, and the EPI packet including the gamma control signals may be transmitted to the data driver ICs 200.

When the gamma control signals for generating the first gamma voltage GMA1 to the tenth gamma voltage GMA10 are distributed and arranged in the EPI packet, there is no specific restriction. In consideration of the residual bits left in a sub-packet, the gamma control signals for generating the first gamma voltage GMA1 to the tenth gamma voltage GMA10 may be distributed and arranged.

Moreover, it has been described above that the gamma control signals for generating the first gamma voltage GMA1 to the tenth gamma voltage GMA10 are encoded into 2 bits to 4 bits, but the gamma control signals may be encoded into 4 or more bits (for example, 8 bits).

In this way, the gamma control signals for generating the first gamma voltage GMA1 to the tenth gamma voltage GMA10 may be variably encoded into a certain number of bits, and distributed to the plurality of control packets.

As described above, the gamma control signals for generating the first gamma voltage GMA1 to the tenth gamma voltage GMA10 may be encoded into a variable number of bits, and thus, the gamma voltages can be accurately set.

When the range of each of the second gamma voltage GMA1 to the fourth gamma voltage GMA4 and the seventh gamma voltage GMA7 to the ninth gamma voltage GMA9 is composed of 4 bits, a gamma voltage is generated in units of 0.2375 V as expressed in the following Equation (3). Therefore, the target values of the second gamma voltage GMA1 to the fourth gamma voltage GMA4 and the seventh gamma voltage GMA7 to the ninth gamma voltage GMA9 can be minutely set.

$$7.6V(VDD)-3.8V(VDD/2)/16(4\text{ bits})=0.2375V \quad (3)$$

In the LCD device and the driving method thereof according to the embodiments of the present invention, by forming the gamma voltage generator 250 inside the data driver IC 200, the number of transmission lines that are formed on a PCB for connecting a gamma voltage generator and a data driver IC in the related art are reduced. Accordingly, the area of the PCB can decrease.

Moreover, by decreasing the number of transmission lines formed in the PCB, the layer of the PCB is reduced, thus enabling the simple configuration of the PCB.

Moreover, according to the embodiments of the present invention, PCBs are manufactured at low cost, and thus, the price competitiveness of LCD devices can increase.

In the related art, twenty resistors and ten capacitors are applied for generating a first gamma voltage to tenth gamma voltage, and thus, the manufacturing cost of LCD devices increase. However, in the LCD device and the driving method thereof according to the embodiments of the present invention, by mounting the gamma voltage generator on the data driver IC, the manufacturing cost of LCD devices can be saved.

In the LCD device according to the embodiments of the present invention, the area of the PCB with the driving circuit mounted thereon can be reduced.

In the LCD device according to the embodiments of the present invention, the layer of the PCB with the driving circuit mounted thereon can decrease.

According to the embodiments of the present invention, PCBs are manufactured at low cost, and thus, the price competitiveness of LCD devices can increase.

In the LCD device and the driving method thereof according to the embodiments of the present invention, the gamma voltages are minutely set, thus enhancing the display quality of images.

In the LCD device and the driving method thereof according to the embodiments of the present invention, the number of transmission lines formed on the PCB decreases by mounting the gamma voltage generator on the data driver IC, thus saving the manufacturing cost.

In addition to the aforesaid features and effects of the present invention, other features and effects of the present invention can be newly construed from the embodiments of the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A liquid crystal display (LCD) device, comprising:

a plurality of data driver ICs comprising a gamma voltage generator that generates a gamma voltage;

a timing controller that generates an embedded point-to-point interface (EPI) packet for controlling the data driver ICs;

an EEPROM storing packet data that controls the gamma voltage;

a power supply that generates a driving voltage;

a reference voltage generator that reduces the driving voltage, and supplies the reduced driving voltage to the data driver ICs; and a printed circuit board (PCB), the reference voltage generator, the data driver ICs, and the timing controller being mounted on the PCB, wherein a first transmission line which connects the reference voltage generator and the data driver ICs, and a second transmission line which connects the timing controller and the data driver ICs are formed on the PCB, wherein the gamma voltage generator generates a plurality of gamma voltages based on the reference voltage directly supplied from the reference voltage generator external to the data driver ICs via the first transmission line and the EPI packet directly supplied from the timing controller via the second transmission line.

2. The LCD device of claim 1, wherein the timing controller adds a plurality of control signals that control the data driver ICs, RGB image data, and a plurality of gamma control signals that controls the gamma voltage into the EPI packet, and supplies the EPI packet to the data driver ICs.

3. The LCD device of claim 2, wherein the timing controller generates the gamma control signals by using the packet data stored in the EEPROM, and configures the gamma control signals into a control packet to add the gamma control signals into the EPI packet.

4. The LCD device of claim 2, wherein the timing controller configures the control signals for controlling the data driver ICs into a plurality of control packets, and the gamma control signals to the control packets which are configured with the control signals.

5. The LCD device of claim 2, wherein the timing controller distributes the gamma control signals to a spare storage space that is left after the control signals for controlling the data driver ICs are added into a plurality of control packets.

6. The LCD device of claim 2, wherein the timing controller encodes a plurality of gamma control signals that control first to tenth gamma voltages into a same number of bits, and distributes the encoded gamma control signals to the plurality of control packets.

7. The LCD device of claim 2, wherein the timing controller variably encodes a plurality of gamma control signals that controls first to tenth gamma voltages into a certain number of bits, and distributes the encoded gamma control signals to the plurality of control packets.

8. The LCD device of claim 1, wherein the gamma voltage generator comprises:

a plurality of resistors serially connected to each other;

a plurality of decoders connected to respective output nodes of the resistors;

a plurality of buffers connected to respective output terminals of the decoders; and a plurality of switches connected to respective output terminals of the buffers.

9. The LCD device of claim 8, wherein, the gamma voltage generator generates a high gamma voltage that generates a positive data voltage by using a plurality of resistors which are connected serially between a driving voltage terminal and a reference voltage terminal, and the gamma voltage generator generates a low gamma voltage that generates a negative data voltage by using a plurality of resistors which are connected serially between the reference voltage terminal and a ground voltage terminal.

10. The LCD device of claim 8, wherein the gamma voltage generator generates a high gamma voltage and a low gamma voltage to have a range corresponding to a bit of the gamma control signal inputted to the decoders.

11. The LCD device of claim 10, wherein the gamma voltage generator generates first to fifth gamma voltages as the high gamma voltage, and generates sixth to tenth gamma voltages as the low gamma voltage.

12. The LCD device of claim 1, wherein the reference voltage generator drops the driving voltage by half to generate a reference voltage, and supplies the reference voltage to the gamma voltage generator.

13. The LCD device of claim 12, wherein the reference voltage generator generates a first gamma voltage and supplies the first gamma voltage to the gamma voltage generator.

14. An apparatus comprising:

a driver integrated circuit configured to include a gamma voltage generator therein as a result of an embedded point-to-point interface being implemented with respect to a timing controller, said gamma voltage generator configured to receive a reference voltage from a reference voltage generator via a reduced number of signal lines compared to an apparatus having a conventional gamma voltage generator configured outside of a conventional driver integrated circuit, wherein the reference voltage generator outputs only one reference voltage that is one-half of a driving voltage applied to the reference voltage generator.

15. The apparatus of claim 14, wherein embedded point-to-point interface packets are used to facilitate interfacing between said driver integrated circuit and said timing controller.

16. The apparatus of claim 15, further comprising:

a memory device configured to store said embedded point-to-point interface packets.

* * * * *